US008680443B2

(12) United States Patent
McMillin et al.

(10) Patent No.: US 8,680,443 B2
(45) Date of Patent: Mar. 25, 2014

(54) COMBINED MATERIAL LAYERING TECHNOLOGIES FOR ELECTRIC HEATERS

(75) Inventors: James McMillin, Algonquin, IL (US); Louis P. Steinhauser, St. Louis, MO (US); Kevin Ptasienski, O'Fallon, MO (US)

(73) Assignee: Watlow Electric Manufacturing Company, St. Louis, MO (US)

( * ) Notice: Subject to any disclaimer, the term of this patent is extended or adjusted under 35 U.S.C. 154(b) by 2104 days.

(21) Appl. No.: 10/752,359

(22) Filed: Jan. 6, 2004

(65) Prior Publication Data

US 2005/0145617 A1 Jul. 7, 2005
US 2007/0278213 A2 Dec. 6, 2007

(51) Int. Cl.
*H05B 3/26* (2006.01)
*H05B 3/28* (2006.01)

(52) U.S. Cl.
USPC ..... 219/543; 219/548

(58) Field of Classification Search
USPC ..... 219/212, 444.1, 538, 543, 853, 553, 219/445.1, 541, 540, 539, 619, 216, 469, 219/618, 600; 100/300
See application file for complete search history.

(56) References Cited

U.S. PATENT DOCUMENTS 4,920,254 A * 4/1990 DeCamp et al. ..... 219/547
5,227,610 A * 7/1993 Schultheis et al. ..... 219/445.1
5,822,675 A 10/1998 Paquet et al.
5,889,261 A * 3/1999 Boardman ..... 219/543
5,973,296 A * 10/1999 Juliano et al. ..... 219/424
6,127,654 A * 10/2000 Fletcher ..... 219/216
6,222,166 B1 4/2001 Lin et al.
6,305,923 B1 * 10/2001 Godwin et al. ..... 425/143
6,433,319 B1 8/2002 Bullock et al.
6,580,061 B2 6/2003 Black
6,762,396 B2 * 7/2004 Abbott et al. ..... 219/543
2003/0066828 A1 * 4/2003 Boardman ..... 219/543

FOREIGN PATENT DOCUMENTS

WO WO 95/15670 6/1995

OTHER PUBLICATIONS

PCT International Search Report, PCT/US2005/000341 (5 pages); and Written Opinion (7 pages), International Filing Date Jan. 5, 2005.

* cited by examiner

*Primary Examiner* — Joseph M Pelham
(74) *Attorney, Agent, or Firm* — Brinks Gilson & Lione

(57) ABSTRACT

A layered heater is provided with a dielectric layer formed by a first layered process, a resistive layer formed on the dielectric layer, the resistive layer formed by a second layered process, and a protective layer formed on the resistive layer, wherein the protective layer is formed by one of the first or second layered processes or yet another layered process. The first layered process is different than the second layered process in order to take advantage of the unique processing benefits of each of the first and second layered processes for a synergistic result. The layered processes include, by way of example, thick film, thin film, thermal spraying, and sol-gel. Additional functional layers are also provided by the present invention, along with methods of forming each of the individual layers.

12 Claims, 5 Drawing Sheets

COMBINED MATERIAL LAYERING TECHNOLOGIES FOR ELECTRIC HEATERS

FIELD OF THE INVENTION

The present invention relates generally to electrical heaters and more particularly to methods of forming individual layers of a layered electrical heater.

BACKGROUND OF THE INVENTION

Layered heaters are typically used in applications where space is limited, when heat output needs vary across a surface, where rapid thermal response is desirous, or in ultra-clean applications where moisture or other contaminants can migrate into conventional heaters. A layered heater generally comprises layers of different materials, namely, a dielectric and a resistive material, which are applied to a substrate. The dielectric material is applied first to the substrate and provides electrical isolation between the substrate and the electrically-live resistive material and also minimizes current leakage to ground during operation. The resistive material is applied to the dielectric material in a predetermined pattern and provides a resistive heater circuit. The layered heater also includes leads that connect the resistive heater circuit to an electrical power source, which is typically cycled by a temperature controller and an over-mold material that protects the lead-to-resistive circuit interface. This lead-to-resistive circuit interface is also typically protected both mechanically and electrically from extraneous contact by providing strain relief and electrical isolation through a protective layer. Accordingly, layered heaters are highly customizable for a variety of heating applications.

Layered heaters may be "thick" film, "thin" film, or "thermally sprayed," among others, wherein the primary difference between these types of layered heaters is the method in which the layers are formed. For example, the layers for thick film heaters are typically formed using processes such as screen printing, decal application, or film printing heads, among others. The layers for thin film heaters are typically formed using deposition processes such as ion plating, sputtering, chemical vapor deposition (CVD), and physical vapor deposition (PVD), among others. Yet another series of processes distinct from thin and thick film techniques are those known as thermal spraying processes, which may include by way of example flame spraying, plasma spraying, wire arc spraying, and HVOF (High Velocity Oxygen Fuel), among others.

With thick film layered heaters, the type of material that may be used as the substrate is limited due to the incompatibility of the thick film layered processes with certain substrate materials. For example, 304 stainless steel for high temperature applications is without a compatible thick film dielectric material due to the relatively high coefficient of thermal expansion of the stainless steel substrate. The thick film dielectric materials that will adhere to this stainless steel are most typically limited in temperature that the system can endure before (a) the dielectric becomes unacceptably "conductive" or (b) the dielectric delaminates or suffers some other sort of performance degradation. Additionally, the processes for thick film layered heaters involve multiple drying and high temperature firing steps for each coat within each of the dielectric, resistive element, and protective layers. As a result, processing of a thick film layered heater involves multiple processing sequences.

Similar limitations exist for other layered heaters using the processes of thin film and thermal spraying. For example, if a resistive layer is formed using a thermal spraying process, the pattern of the resistive element must be formed by a subsequent operation such as laser etching or water-jet carving, unless a process such as shadow masking is employed, which often results in imperfect resistor patterns. As a result, two separate process steps are required to form the resistive layer pattern. Therefore, each of the processes used for layered heaters has inherent drawbacks and inefficiencies compared with other processes.

SUMMARY OF THE INVENTION

In one preferred form, the present invention provides a layered heater comprising a dielectric layer formed by a first layered process, a resistive layer formed on the dielectric layer, the resistive layer formed by a second layered process, and a protective layer formed on the resistive layer, wherein the protective layer is formed by one of the first or second layered processes or yet another layered process. The first layered process is different than the second layered process in order to take advantage of the unique processing benefits of each of the first and second layered processes for a synergistic result. The layered processes include, by way of example, thick film, thin film, thermal spraying, and sol-gel.

In another form, a layered heater is provided that comprises a first layer formed by a layered process, a second layer formed on the first layer, wherein the second layer is formed by a layered process different than the layered process of the first layer. The layers are further selected from a group of functional layers consisting of a bond layer, a graded layer, a dielectric layer, a resistive layer, a protective layer, an overcoat layer, a sensor layer, a ground plane layer, an electrostatic layer, and an RF layer, among others.

Additionally, a layered heater is provided that comprises a substrate a bond layer formed on the substrate, a dielectric layer formed on the bond layer, and a resistive layer formed on the dielectric layer. The dielectric layer is formed by a first layered process, and the resistive layer formed by a second layered process. Similarly, a layered heater is provided that comprises a substrate, a graded layer formed on the substrate, a dielectric layer formed on the graded layer, and a resistive layer formed on the dielectric layer. The dielectric layer is formed by a first layered process, and the resistive layer formed by a second layered process.

In yet another form, a layered heater is provided that comprises a substrate, a dielectric layer formed on the substrate, the dielectric layer formed by a first layered process, a resistive layer formed on the dielectric layer, the resistive layer formed by a second layered process, and a protective layer formed on the resistive layer, wherein the protective layer is formed by a layered process. In another form, an overcoat layer is formed on the protective layer, and the overcoat layer is also formed by a layered process. The first layered process is different than the second layered process in order to take advantage of the unique processing benefits of each of the first and second layered processes for a synergistic result.

According to a method of the present inventions a layered heater is formed by the steps of forming a first layer by a first layered process and forming a second layer on the first layer by a second layered process. The first and second layers are preferably a dielectric layer and a resistive layer, respectively, and another protective layer is formed on the resistive layer according to another method of the present invention. The first layered process is different than the second layered process.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

Corresponding reference numerals indicate corresponding parts throughout the several views of the drawings.

DETAILED DESCRIPTION OF THE PREFERRED EMBODIMENTS

The following description of the preferred embodiments is merely exemplary in nature and is in no way intended to limit the invention its application, or uses.

Figure 1:
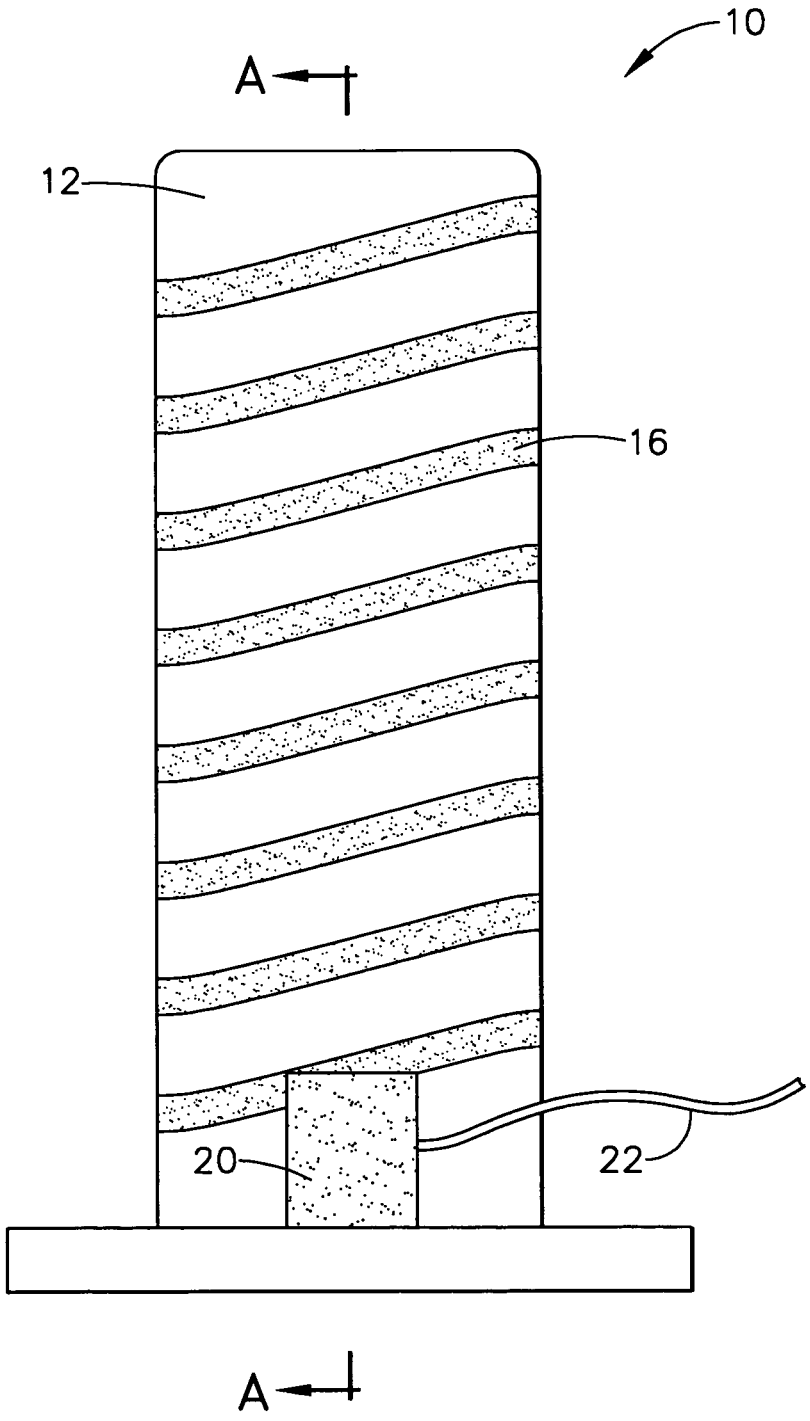
FIG. 1 is a side view of layered heater constructed in accordance with the principles of the present invention.
Figure 2:
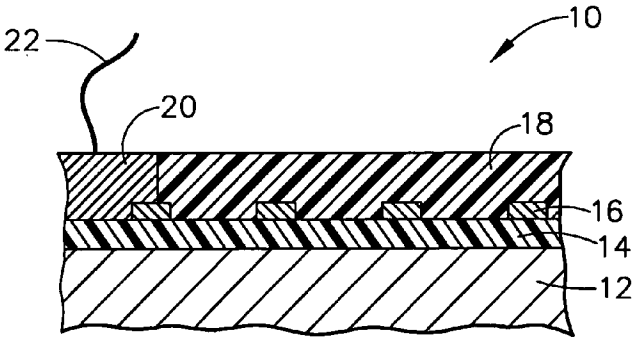
FIG. 2 is an enlarged partial cross sectional view, taken along line A-A of FIG. 1, of a layered heater constructed in accordance with the principles of the present invention.

Referring to FIGS. 1 and 2, a layered heater in accordance with one form of the present invention is illustrated and generally indicated by reference numeral 10. The layered heater 10 comprises a number of layers disposed on a substrate 12, wherein the substrate 12 may be a separate element disposed proximate the part or device to be heated, or the substrate 12 may be the part or device itself. As best shown in FIG. 2, the layers preferably comprise a dielectric layer 14, a resistive layer 16, and a protective layer 18. The dielectric layer 14 provides electrical isolation between the substrate 12 and the resistive layer 16 and is formed on the substrate 12 in a thickness commensurate with the power output, applied voltage, intended application temperature or combinations thereof, of the layered heater 10. The resistive layer 16 is formed on the dielectric layer 14 and provides a heater circuit for the layered heater 10, thereby providing the heat to the substrate 12. The protective layer 18 is formed on the resistive layer 16 and is preferably an insulator, however other materials such as an electrically or thermally conductive material may also be employed according to the requirements of a specific heating application while remaining within the scope of the present invention. Additionally, the layered heater 10 is shown in a generally cylindrical configuration with a spiral resistive circuit, however, other configurations and circuit patterns may also be employed while remaining within the scope of the present invention.

As further shown, terminal pads 20 are preferably disposed on the dielectric layer 14 and are in contact with the resistive layer 16. Accordingly, electrical leads 22 are in contact with the terminal pads 20 and connect the resistive layer 16 to a power source (not shown). (Only one terminal pad 20 and one electrical lead 22 are shown for clarity, and it should be understood that two terminal pads 20 with one electrical lead 22 per terminal pad 20 is the preferred form of the present invention). The terminal pads 20 are not required to be in contact with the dielectric layer 14 and thus the illustration of the embodiment in FIG. 1 is not intended to limit the scope of the present invention, so long as the terminal pads 20 are electrically connected to the resistive layer 16 in some form. As further shown, the protective layer 18 is disposed over the resistive layer 16 and is preferably a dielectric material for electrical isolation and protection of the resistive layer 16 from the operating environment. Additionally, the protective layer 18 may cover a portion of the terminal pads so long as there remains sufficient area to promote an electrical connection with the power source.

Preferably, the individual layers of the layered heater 10 are formed by different layered processes in order to take advantage of the benefits of each process for an overall synergistic result. In one form, the dielectric layer 14 is formed by a thermal spraying process and the resistive layer 16 is formed by a thick film process. By using a thermal spring process for the dielectric layer 14, an increased number of materials can be used as the substrate 12 that would otherwise be incompatible with thick film application of the dielectric layer 14. For example, a 304 stainless steel for a high temperature application can be used as a substrate 12, which cannot be used with a thick film process due to the excessive coefficient of thermal expansion (CTE) mismatch between this alloy and the possible thick film dielectric glasses. It is generally known and understood that the CTE characteristics and insulation resistance property of thick film glasses is inversely proportional. Other compatibility issues may arise with substrates having a low temperature capability, e.g., plastics, and also with a substrate that comprises a heat treated surface or other property that could be adversely affected by the high temperature firing process associated with thick films. Additional substrate 12 materials may include, but are not limited to, nickel-plated copper, aluminum, stainless steel, mild steels, tool steels, refractory alloys, aluminum oxide, and aluminum nitride. In using a thick film process, the resistive layer 16 is preferably formed on the dielectric layer 14 using a film printing head in one form of the present invention. Fabrication of the layers using this thick film process is shown and described in U.S. Pat. No. 5,973,296, which is commonly assigned with the present application and the contents of which are incorporated herein by reference in their entirety. Additional thick film processes may include, by way of example, screen printing, spraying, rolling, and transfer printing, among others.

The terminal pads 20 are also preferably formed using a thick film process in one form of the present invention. Additionally, the protective layer 18 is formed using a thermal spraying process. Therefore, the preferred form of the present invention includes a thermal sprayed dielectric layer 14, a thick film resistive layer 16 and terminal pads 20, and a thermal sprayed protective layer 18. In addition to the increased number of compatible substrate materials, this form of the present invention has the added advantage of requiring only a single firing sequence to cure the resistive layer 16 and the terminal pads 20 rather than multiple firing sequences that would be required if all of the layers were formed using a thick film layered process. With only a single firing sequence, the selection of resistor materials is greatly expanded. A typical thick film resistor layer must be able to withstand the temperatures of the firing sequence of the protective layer, which will often dictate a higher firing temperature resistor. By enabling the selection of a lower firing temperature resistor material the interface stresses between the high expansion substrate and the lower expansion dielectric layer will be reduced, thus promoting a more reliable system. As a result the layered heater 10 has broader applicability and is manufactured more efficiently according to the teachings of the present invention.

In addition to using a thermal spraying process for the dielectric layer 14 and the protective layer 18 and a thick film process for the resistive layer 16 and the terminal pads 20, other combinations of layered processes may be employed for each of the individual layers while remaining within the scope of the present invention. For example, Table I below illustrates possible combinations of layered processes for each of the layers within the layered heater.

TABLE I

| Layer | Processes | Processes | Processes | Processes |
|---|---|---|---|---|
| Dielectric | Sol-Gel | Thermal Spray | Thermal Spray | Sol-Gel |
| Resistive | Thick Film | Thin Film | Thick Film | Thermal Spray |
| Terminal Pads | Thick Film | Thin Film | Thick Film | Thermal Spray |
| Protective | Sol-Gel | Thermal Spray | Sol-Gel | Sol-Gel |

Therefore, a number of combinations of layered processes may be used for each individual layer according to specific heater requirements. The processes for each layer as shown in Table I should not be construed as limiting the scope of the present invention, and the teachings of the present invention are that of different layered processes for different functional layers within the layered heater 10. Thus, a first layered process is employed for a first layer (e.g., thermal spraying for the dielectric layer 14), and a second layered process is employed for a second layer (e.g., thick film for the resistive layer 16) in accordance with the principles of the present invention.

The thermal spraying processes may include, by way of example, flame spraying, plasma spraying, wire arc spraying, and HVOF (High Velocity Oxygen Fuel), among others. In addition to the film printing head as described above, the thick film processes may also include, by way of example, screen printing, spraying, rolling, and transfer printing, among others. The thin film processes may include ion plating, sputtering, chemical vapor deposition (CVD), and physical vapor deposition (PVD), among others. Thin film processes such as those disclosed in U.S. Pat. Nos. 6,305,923, 6,341,954, and 6,575,729, which are incorporated herein by reference in their entirety, may be employed with the heater system 10 as described herein while remaining within the scope of the present invention. With regard to the sol-gel process, the layers are formed using sol-gel materials. Generally, the sol-gel layers are formed using processes such as dipping, spinning, or painting, among others. Thus, as used herein, the term "layered heater" should be construed to include heaters that comprise functional layers (e.g., dielectric layer 14, resistive layer 16, and protective layer 18, among others as described in greater detail below), wherein each layer is formed through application or accumulation of a material to a substrate or another layer using processes associated with thick film, thin film, thermal spraying, or sol-gel, among others. These processes are also referred to as "layered processes," "layering processes," or "layered heater processes."

Figure 3A:
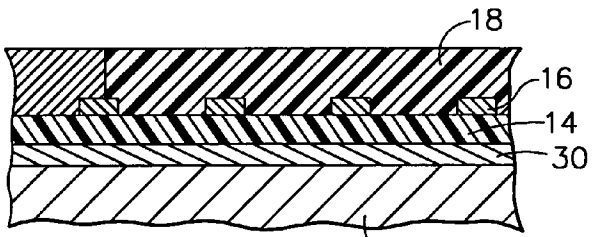
FIG. 3*a* is an enlarged partial cross sectional view of a layered heater having a bond layer constructed in accordance with the principles of the present invention.

Referring now to FIG. 3*a*, an additional functional layer between the substrate 12 and the dielectric layer 14 may be beneficial or even required when using thermal spraying processes for the dielectric layer 14. This layer is referred to as a bond layer 30 and functions to promote adhesion of the thermally sprayed dielectric layer 14 to the substrate 12. The bond layer 30 is preferably formed on the substrate 12 using a layered process such as wire arc spraying and is preferably a material such as a nickel-aluminum alloy.

Figure 3B:
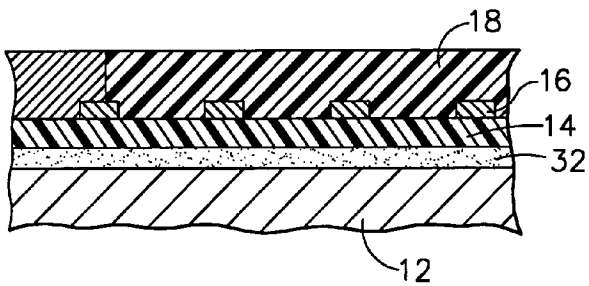
FIG. 3*b* is an enlarged partial cross sectional view of a layered heater having a graded layer constructed in accordance with the principles of the present invention.
Figure 4:
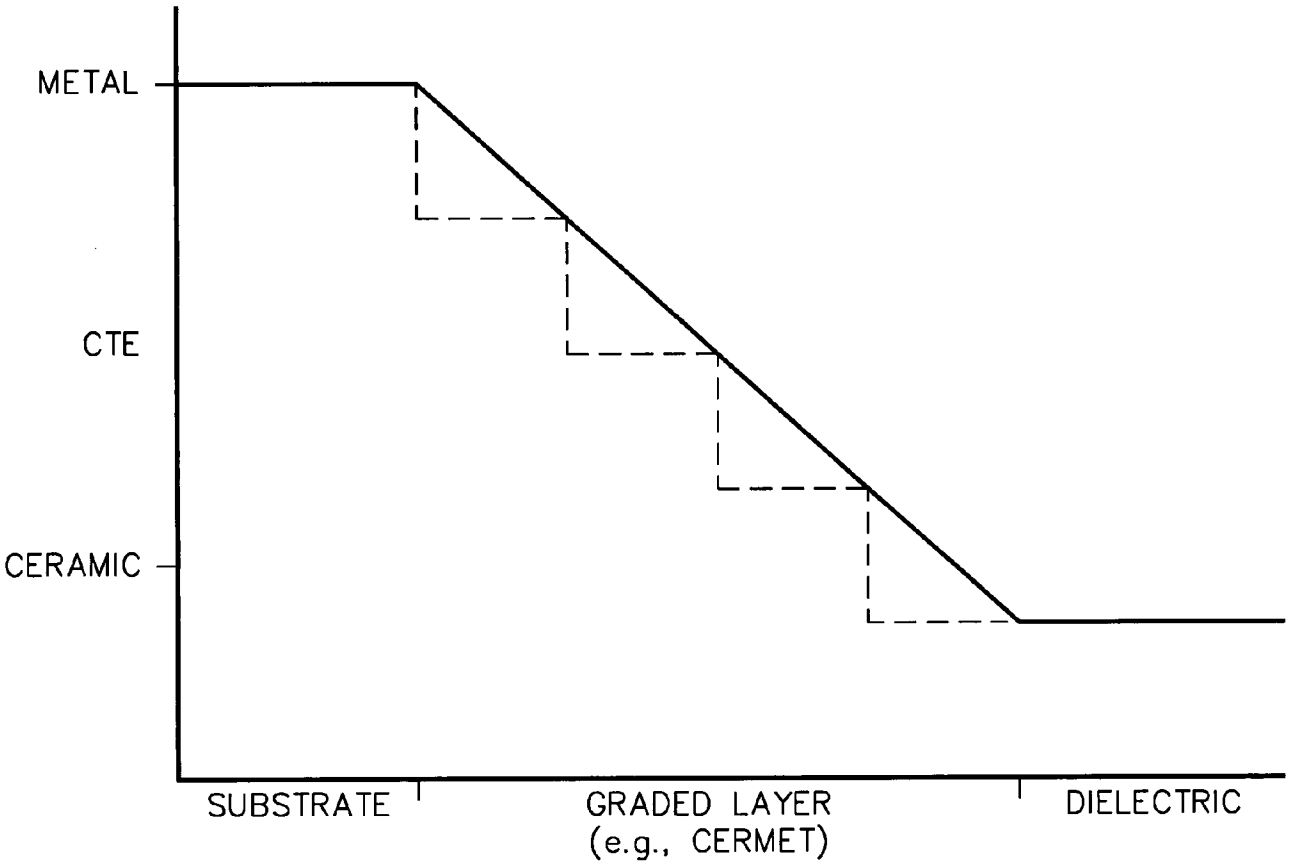
FIG. 4 is a graph illustrating the transition of CTE from a substrate to a dielectric layer in accordance with the principles of the present invention.

As shown in FIG. 3*b*, yet another functional layer may be employed between the substrate 12 and the dielectric layer 14. This layer is referred to as a graded layer 32 and is used to provide a CTE transition between the substrate 12 and the dielectric layer 14 when the difference in CTEs between these layers is relatively large. For example, when the substrate 12 is metal and the dielectric layer 14 is ceramic, the difference in CTEs is relatively large and the structural integrity of the layered heater 10 would be degraded due to this difference. Accordingly, the graded layer 32 provides a transition in CTE as illustrated in FIG. 4, which may be linear/continuous or step-changed as shown by the solid and dashed traces, respectively, or another function as required by specific application requirements. The material for the graded layer 32 is preferably a cermet, a material consisting of a blend of ceramic and metal powders, however, other materials may also be employed while remaining within the scope of the present invention.

Figure 3C:
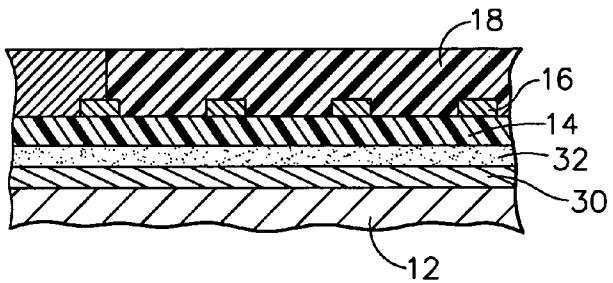
FIG. 3*c* is an enlarged partial cross sectional view of a layered heater having a bond layer and a graded layer constructed in accordance with the principles of the present invention.

Referring now to FIG. 3*c*, both a bond layer 30 and a graded layer 32 as previously described may be employed in another form of the present invention. As shown, the bond layer 30 is formed on the substrate 12, and the graded layer 32 is formed on the bond layer 30, wherein the bond layer 30 is used to promote an improved adhesion characteristic between the substrate 12 and the graded layer 32. Similarly, the dielectric layer 14 is formed on the graded layer 32 and thus the graded layer 32 provides a transition in CTE from the substrate 12 to the dielectric layer 14.

Figure 5:
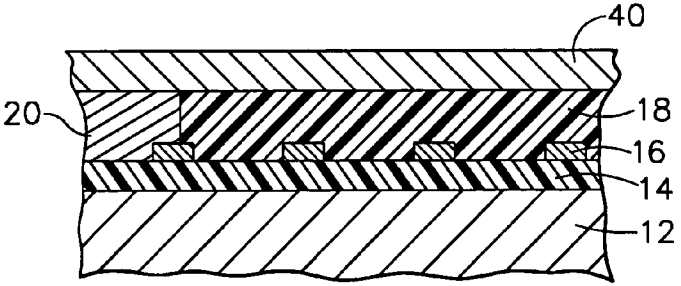
FIG. 5 is an enlarged partial cross sectional view of a layered heater having an overcoat layer constructed in accordance with the principles of the present invention.

As shown in FIG. 5, the layered heater 10 may also employ an additional functional layer that is formed on the protective layer 18, namely, an overcoat layer 40. The overcoat layer 40 is preferably formed using a layered process and may include by way of example a machinable metal layer, a non-stick coating layer, an emissivity modifier layer, a thermal insulator layer, a visible performance layer, (e.g., temperature sensitive material that indicates temperature via color), or a durability enhancer layer, among others. There may also be additional preparatory layers between the protective layer 18 and the overcoat layer 40 in order to enhance performance of the overcoat layer 40 while remaining within the scope of the present invention. Accordingly, the functional layers as shown and described herein should not be construed as limiting the scope of the present invention. Additional functional layers, further, in different locations throughout the buildup of layers, may be employed according to specific application requirements.

Figure 6:
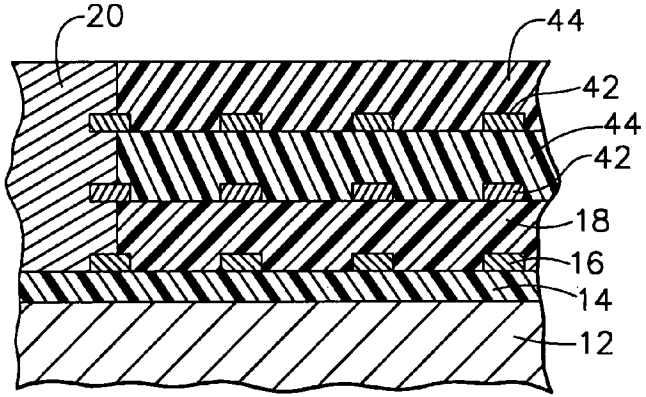
FIG. 6 is an enlarged partial cross sectional view of a layered heater having a plurality of resistive layers constructed in accordance with the principles of the present invention.

These functional layers may also include additional resistive layers as shown in FIG. 6, wherein a plurality of resistive layers 42 are formed on a corresponding plurality of dielectric layers 44. The plurality of resistive layers 42 may be required for additional heater output in the form of wattage or may also be used for redundancy of the layered heater 10, for example in the event that the resistive layer 16 fails. Moreover, the plurality of resistive layers 42 may also be employed to satisfy resistance requirements for applications where high or low resistance is required in a small effective heated area, or over a limited footprint. Additionally, multiple circuits, or resistive layer patterns, may be employed within the same resistive layer, or among several layers, while remaining within the scope of the present invention. For example, each of the resistive layers 42 may have different patterns or may be electrically tied to alternate power terminals. Accordingly, the configuration of the plurality of resistive layers 42 as illustrated should not be construed as limiting the scope of the present invention.

Figure 7B:
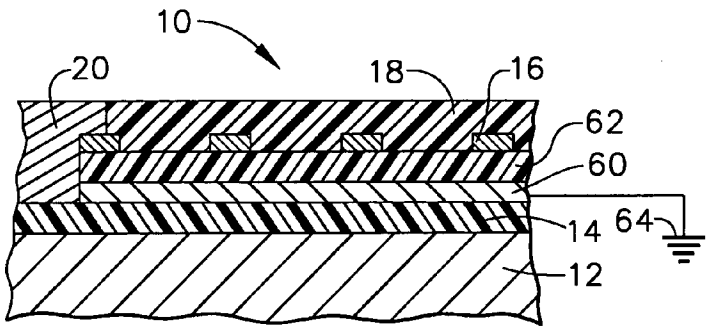
FIG. 7*b* is an enlarged partial cross sectional view of a layered heater having a ground shield layer constructed in accordance with the principles of the present invention.
Figure 7A:
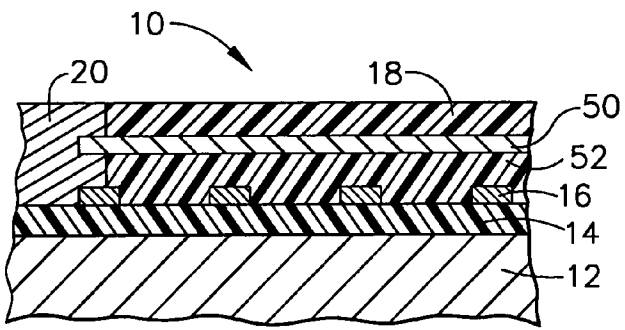
FIG. 7*a* is an enlarged partial cross sectional view of a layered heater having a sensor layer constructed in accordance with the principles of the present invention.

Additional forms of functional layers are illustrated in FIGS. 7*a*-7*d*, which are intended to be exemplary and not to limit the possible functional layers for the layered heater 10 according to the teachings of the present invention. As shown in FIG. 7*a*, the additional functional layer is a sensor layer 50. The sensor layer 50 is preferably a Resistance Temperature Detector (RTD) temperature sensor and is formed on a dielectric layer 52 using a thin film process, although other processes may be employed according to the teachings of the present invention. FIG. 7*b* illustrates a layered heater 10 having a functional layer of a ground shield 60, which is employed to isolate and drain any leakage current to and/or from the layered heater 10. As shown, the ground shield 60 is formed between dielectric layers 14 and 62 and is connected to an independent terminal for appropriate connection to a designated leakage path 64. The ground shield 60 is preferably formed using a thick film layered process, however, other layered processes as disclosed herein may also be employed while remaining within the scope of the present invention.

Figure 7D:
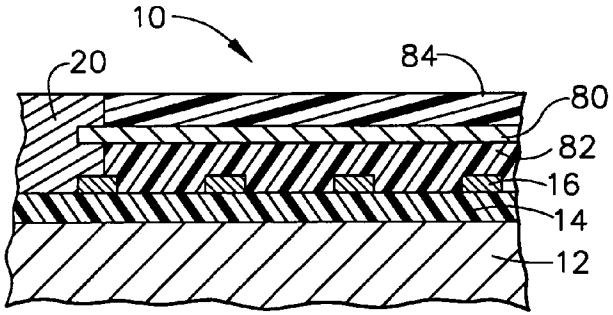
FIG. 7*d* is an enlarged partial cross sectional view of a layered heater having an RF shield constructed in accordance with the principles of the present invention.
Figure 7C:
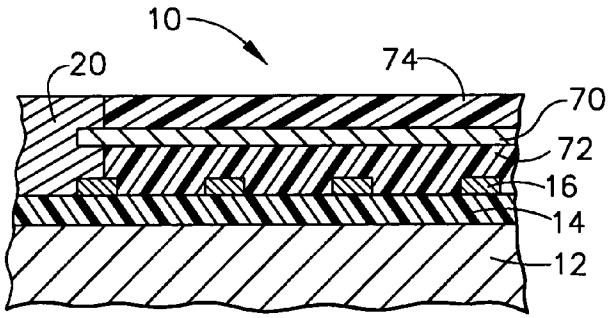
FIG. 7*c* is an enlarged partial cross sectional view of a layered heater having an electrostatic shield constructed in accordance with the principles of the present invention.

As shown in FIG. 7*c*, the additional functional layer is an electrostatic shield 70, which is used to dissipate electrostatic energy directed to and/or from the layered heater 10. Preferably, the electrostatic shield 70 is formed between a dielectric layer 72 and a protective layer 74 as shown. FIG. 7*d* illustrates the additional functional layer of a radio frequency (RF) shield 80, which is used to shield certain frequencies to and/or from the layered heater 10. Similarly, the RF shield 80 is formed between a dielectric layer 82 and a protective layer 84 as shown. The electrostatic shield 70 and RF shield 80 layers are preferably formed using a thick film layered process, however, other layered processes may also be employed while remaining within the scope of the present invention. It should be understood that the additional functional layers as shown and described herein, namely, the sensor layer 50, the ground shield 60, the electrostatic shield 70, and the RF shield 80 may be positioned at various locations adjacent any of the layers of the layered heater 10 and connected to an appropriate power source other than those positions and connections illustrated in FIGS. 7*a*-7*d* while remaining within the scope of the present invention.

Figure 8:
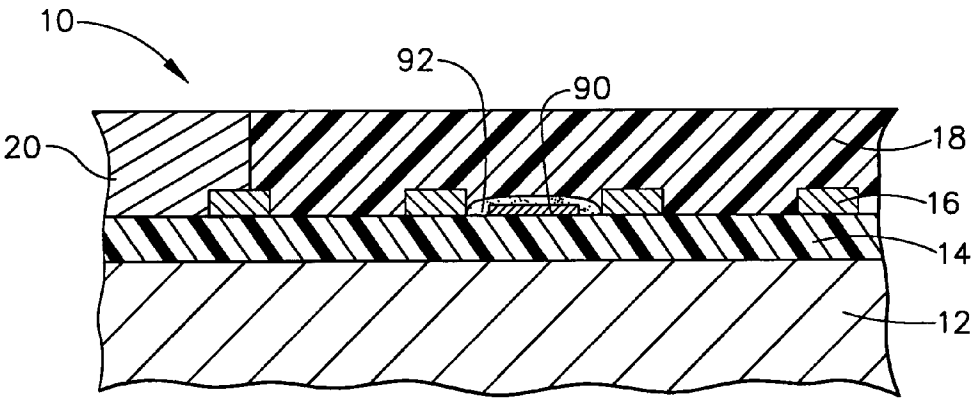
FIG. 8 is an enlarged cross sectional view of a layered heater having an embedded discrete component constructed in accordance with the principles of the present invention.

In addition to employing functional layers as described herein, the layered processes may also be employed to embed discrete components within the layered heater 10. For example, as shown in FIG. 8, a discrete component 90 (e.g., temperature sensor) is embedded between the dielectric layer 14 and the protective layer 18. The discrete component 90 is preferably secured to the resistive layer 16 using the thermal spraying process, which would result in a local securing layer 92 as shown. However, other processes may be employed to secure discrete embedded components while remaining within the scope of the present invention. Additional discrete components may include, but are not limited to, thermocouples, RTDs, thermistors, strain gauges, thermal fuses, optical fibers, and microprocessors and controller among others.

It should be understood that the position within the layers of the additional functional layers and the discrete components is not intended to limit the scope of the present invention. The additional functional layers and the discrete components may be placed in various locations adjacent any of the layers, e.g., between the dielectric layer 14 and the resistive layer 14, between the resistive layer 14 and the protective layer 16, between the substrate 12 and the dielectric layer 14, or adjacent other layers, while remaining within the scope of the present invention.

The description of the invention is merely exemplary in nature and, thus, variations that do not depart from the gist of the invention are intended to be within the scope of the invention. For example, the layered heater 10 as described herein may be employed with a two-wire controller as shown and described in co-pending application Ser. No. 10/719,327, titled "Two-Wire Layered Heater System," filed Nov. 21, 2003, and co-pending application titled "Tailored Heat Transfer Layered Heater System," filed Jan. 6, 2004, both of which are commonly assigned with the present application and the contents of which are incorporated herein by reference in their entirety. Such variations are not to be regarded as a departure from the spirit and scope of the invention.

What is claimed is:

1. A layered heater comprising:

a plurality of resistive layers separated by a corresponding plurality of dielectric layers, wherein the plurality of resistive layers are formed on the corresponding plurality dielectric layers, and at least one of the plurality of resistive layers and the corresponding one of the plurality dielectric layers are formed by different layered processes.

2. The layered heater according to claim 1, wherein the layered processes are selected from a group consisting of thick film, thin film, thermal spray and sol-gel.

3. The layered heater according to claim 1, further comprising a substrate, wherein one of the plurality of dielectric layers is formed on the substrate.

4. The layered heater according to claim 3, wherein the substrate is a stainless steel material.

5. The layered heater according to claim 1, further comprising at least one conductor pad in contact with at least one of the resistive layers.

6. The layered heater according to claim 5, wherein the conductor pad is formed by a layered process selected from a group consisting of thick film, thin film, thermal spray, and sol-gel.

7. The layered heater according to claim 1 further comprising:

a two-wire controller in communication with the layered heater, wherein at least one of the resistive layers has sufficient temperature coefficient of resistance characteristics such that the resistive layer is a heater element and a temperature sensor and the two-wire controller determines temperature of the layered heater using the resistance of the resistive layer and controls heater temperature accordingly.

8. A layered heater comprising:

a substrate;

a graded layer formed on the substrate;

a dielectric layer formed on the graded layer, the dielectric layer formed by a first layered process; and a resistive layer formed on the dielectric layer, the resistive layer formed by a second layered process, wherein the first layered process is different than the second layered process.

9. The layered heater according to claim 8 further comprising:

a protective layer formed on the resistive layer, the protective layer formed by a layered process.

10. A layered heater comprising:

a dielectric layer formed by a sol-gel process;

a resistive layer formed on the dielectric layer, the resistive layer formed by a thick film process; and a protective layer formed on the resistive layer, the protective layer formed by a sol-gel process.

11. A layered heater comprising:

a dielectric layer formed by a thermal spray process;

a resistive layer formed on the dielectric layer, the resistive layer formed by a thick film process; and a protective layer formed on the resistive layer, the protective layer formed by a sol-gel process.

12. A layered heater comprising:

a dielectric layer formed by a sol-gel process;

a resistive layer formed on the dielectric layer, the resistive layer formed by a thermal spray process; and a protective layer formed on the resistive layer, the protective layer formed by a sol-gel process.

* * * * *